United States Patent [19]

Igarashi et al.

[11] Patent Number: 4,717,361

[45] Date of Patent: Jan. 5, 1988

[54] CONTACT FOR CONNECTOR

[75] Inventors: Yoshiaki Igarashi, Mooka; Hiroo Ohtsuka, Utsunomiya; Osamu Hara, Kodaira, all of Japan

[73] Assignees: Daiichi Denshi Kogyo Kabushiki Kaisha; Iwatsu Electronic Co., Inc., both of Tokyo, Japan

[21] Appl. No.: 891,357

[22] Filed: Jul. 29, 1986

[30] Foreign Application Priority Data

Aug. 2, 1985 [JP] Japan ..... 60-119201

[51] Int. Cl.[4] ..... H01R 13/11

[52] U.S. Cl. ..... 439/856

[58] Field of Search ..... 339/258 R, 258 P, 256 R, 339/239 R; 439/856

[56] References Cited

U.S. PATENT DOCUMENTS

| | | | |
|---|---|---|---|
| 3,011,143 | 11/1961 | Dean | 339/258 P X |
| 3,027,534 | 3/1962 | Deakin | 339/258 P X |
| 3,787,801 | 1/1974 | Teagno et al. | 339/258 R |
| 3,818,423 | 6/1974 | McDonough | 339/258 P |
| 3,867,008 | 2/1975 | Gartland, Jr. | 339/258 R |
| 4,588,240 | 5/1986 | Reuhl et al. | 339/258 R |
| 4,607,907 | 8/1986 | Bogursky | 339/258 P |

*Primary Examiner*—William R. Briggs

*Attorney, Agent, or Firm*—Silverman, Cass, Singer & Winburn, Ltd.

[57] ABSTRACT

A contact for a connector, which includes two opposed contact elements for receiving therebetween a male contact of a mating connector. Each the contact element is provided with one or more protrusions on an opposed surface for embracing the male contact. Protrusions of the two opposed contact elements extend to that portions of the opposed contact elements which are devoid of the protrusions so as to overlap each other before the male contact is inserted between the contact elements. With this arrangement, even if the male contact is very thin, pressing force required to securely pressing the male contact by the contact elements is certainly obtained. The contact and the male contact are securely contacted without any torsional force and other forces which would otherwise be caused on these contacts.

7 Claims, 8 Drawing Figures

CONTACT FOR CONNECTOR

BACKGROUND OF THE INVENTION

This invention relates to an improvement of a contact for an electric connector which includes a socket or the like, and more particularly to a contact for a connector having two contact elements receiving therebetween a thin male contact in the form of a pin of a mating connector.

Conventional contacts for connectors including sockets will be explained referring to FIGS. 1*a*–1*d*.

In FIG. 1*a*, a contact 10 comprises two contact elements 10A and 10B in opposition to each other adapted to receive a male contact (not shown) to be inserted in a direction shown by an arrow 20. The contact 10 is located in an insulating block 13 for insulatingly holding the contact 10 therein.

FIG. 1*b* illustrates change in position of the contact 10 when the male contact 12 (shown in a dot-and-dash line) is inserted between the opposed contact elements 10A and 10B of the contact 10. The contact 10 is shown in solid lines before the insertion of the male contact and in dot lines after the insertion.

Assuming that the male contact 12 has a thickness T and the contact 10 has the narrowest clearance G between the contact elements 10A and 10B before the male contact 12 is inserted therebetween, a displacement D of each the contact element 10A or 10B upon insertion of the male contact 12 is indicated as an equation (1).

$$D = \frac{(T - G)}{2} \quad (1)$$

Moreover, after the insertion, a pressing force P to which the male contact 12 is subjected by both the contact elements 10A and 10B in directions shown by arrows 21 is indicated by an equation (2).

$$P = KD = \frac{K(T - G)}{2} \quad (2)$$

where K is a constant.

In case of a contact shown in FIG. 1*c*, projections 11A and 11B at distal ends of the contact elements 10A and 10B of the contact 10 extend toward each other. In producing this contact, after the contact 10 shown in FIG. 1*c* has been obtained by punching a thick plate in a press, the contact elements 10A and 10B are hammered in directions shown by arrows 22 to narrow a clearance G therebetween.

The minimum values of the clearances G in FIGS. 1*a* and 1*c* are zero.

In case of a contact shown in FIG. 1*d*, contact elements 10A and 10B have different lengths $L_1$ and $L_2$, to permit protrusions 11A and 11B to overlap each other, so that a value of clearance G between the contact elements can be negative. In this case, "negative" means that the protrusions overlap each other.

With the contacts 10 shown in FIGS. 1*a* and 1*c*, as the minimum values of the clearance G are zero, it encounters a great difficulty to produce contacts whose clearances G are near to zero. Moreover, the male contact is generally required to be thin as much as possible in order to achieve miniaturization and light weight of the connector to save resources and lower manufacturing cost.

As can be seen from the equation (2), however, even if the clearance G is zero, the pressing force P for embracing the male contact 12 becomes zero or near to zero, when the thickness T of the male contact is near to zero. Such a slight pressing force in conjunction with errors in assembling and molding would give rise to great problems such as incorrect or insufficient contact between the male and female contacts.

With the contact as shown in FIG. 1*a*, moreover, there is a problem in that when the clearance G is zero, contacting portions of the contact elements are not plated in plating after molding. In order to avoid this problem, it has been proposed to working a plated thin plate by pressing into the shape as shown in FIG. 1*a*. According to this proposal, cut surfaces are devoid of plating layers and bent portions are like to be scratched.

In order to solve these problems, the contact as shown in FIG. 1*d* has been used. In this case, the problem of insufficient contact is solved because of the negative clearance G. As can be seen from the drawing, however, the contact elements 10A and 10B are often twisted by the insertion of the male contact. Moreover, even if the male contact 12 is inserted correctly in an axial direction of the contact 10, the male contact 12 would be subjected to a force causing the male contact 12 to be tilted. Accordingly, guides on the insulating block are needed in order to maintain the direction of the insertion of the male contact correctly. Moreover, as the contact elements 10A and 10B have the different lengths $L_1$ and $L_2$, it is usual to select the shorter length $L_2$ first of all so as to obtain a required pressing force P, and then the longer length $L_1$ is determined. As a result, the length $L_1$ is apt to become longer and obstructs the miniaturization of the connector.

SUMMARY OF THE INVENTION

It is an object of the invention to provide an improved contact for a connector, which eliminates all the disadvantages of the prior art and which maintains a sufficient pressing force for securely contacting a mating male contact even if the male contact is very thin and does not cause any torsional force or other undesirable stresses when the male contact is inserted between contact elements of the contact.

In order to achieve this object, in a contact for a connector, said contact including two opposed contact elements for receiving therebetween a male contact of a mating connector, according to the invention each said contact element is provided with at least one protrusion on an opposed surface for embracing said male contact, so that protrusions of said two opposed contact elements extend to portions of the opposed contact elements devoid of the protrusions to overlap each other before the male contact is inserted between the contact elements.

With this arrangement, the pressing force P having more than a required contact value can be obtained because of the negative value of the clearance G. Moreover, the contact elements and male contact are not subjected to any torsional force and other undesirable stresses in directions different from the inserting direction of the male contact, owing to the protrusions at different positions in the same plane. Therefore, the contact according to the invention achieves reliable and stable contacting between contacts.

In a preferred embodiment of the invention, each the protrusion has a U-shaped cross-section in a plane substantially perpendicular to an inserting direction of the male contact.

In another embodiment, each protrusion is formed by bending the contact element along lines substantially perpendicular to an inserting direction of the male contact.

In a preferred embodiment, the protrusions are substantially aligned with each other in a direction substantially perpendicular to an inserting direction of the male contact on the opposed surface of each contact element.

It is preferable for the balance in stresses that the sum of numbers of the protrusions of the two opposed contact elements is an odd number more than three.

The invention will be more fully understood by referring to the following detailed specification and claims taken in connection with the appended drawings.

DESCRIPTION OF THE PREFERRED EMBODIMENT

Figure 1A:
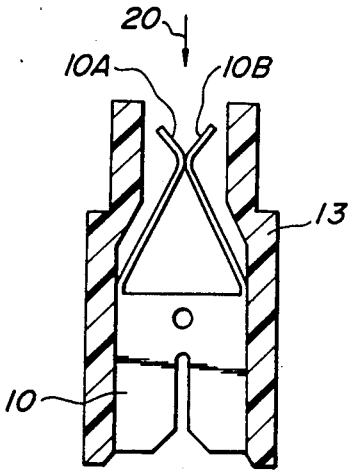
FIG. 1a PRIOR ART
FIG. 1*a* is a sectional view illustrating a contact of the prior art.
Figure 1B:
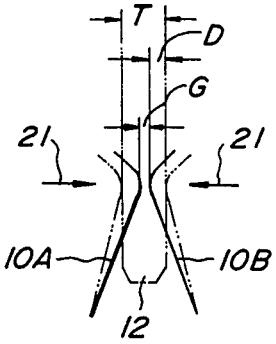
FIG. 1b PRIOR ART
FIG. 1*b* illustrates change in position of the contact shown in FIG. 1*a* when a male contact is inserted.
Figure 1C:
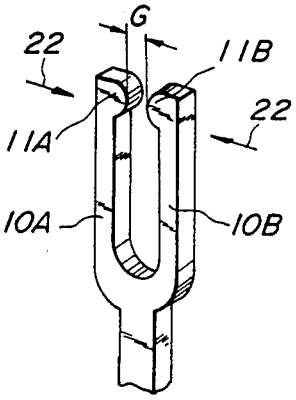
FIG. 1c PRIOR ART
FIG. 1*c* is a perspective view of a contact of the prior art having protrusions at ends of contact elements.
Figure 1D:
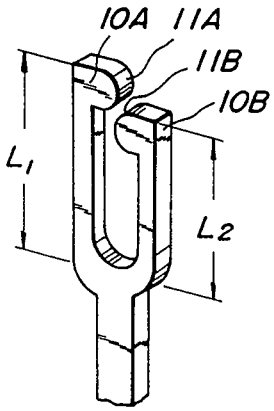
FIG. 1d PRIOR ART
FIG. 1*d* is a perspective view of another contact of the prior art having protrusions of different lengths.
Figure 2A:
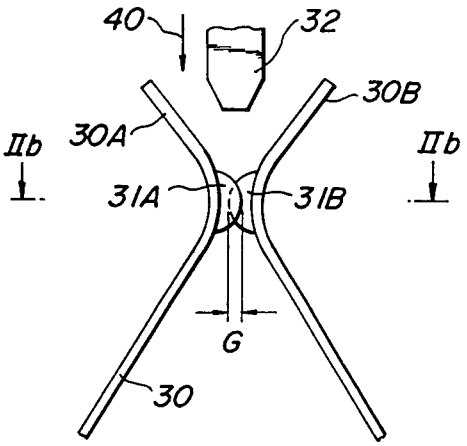
FIG. 2*a* is a front elevation of one embodiment of a contact according to the invention.

FIGS. 2*a*–2*d* illustrate one embodiment of a contact according to the invention. FIG. 2*a* illustrates a front end of the contact 30. Contact elements 30A and 30B of the contact 30 have protrusions 31A and 31B, respectively, between which a male contact 32 is inserted in a direction shown by an arrow 40. A value of a clearance G between the opposed protrusions 31A and 31B is negative. In other words, the protrusions of the contact elements extend to those portions of the elements which are devoid of the protrusions so as to permit the protrusions to overlap before the male contact is inserted therebetween.

Figure 2B:
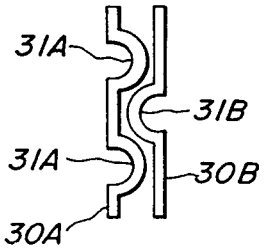
FIG. 2*b* is a partial sectional view taken along the line II*b*—II*b* in FIG. 2*a;*

As shown in FIG. 2*b* which is a cross-sectional view taken along a line II*b*—II*b* in FIG. 2*a*, the contact element 30A includes the two protrusions 31A and the contact element 30B includes one protrusion 31B.

As the value of the clearance G is negative as shown in FIG. 2*a*, even if the thickness of the male contact 32 is zero (although it is not an actual case), the pressing force P is constant which is not zero. Moreover, as these protrusions 31A and 31B are located in the same plane as the sectional surface II*b*—II*b*, the contact 30 and the male contact 32 are not subjected to any torsional force and other forces in directions different from the inserting direction of the male contact.

Figure 2C:
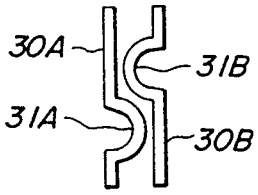
FIG. 2*c* is a partial sectional view of a contact of another embodiment of the invention.
Figure 2D:
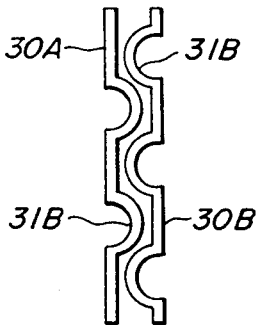
FIG. 2*d* is a partial sectional view of a contact of a further embodiment of the invention.

FIGS. 2*c* and 2*d* illustrate contacts having two and five protrusions 31A and 31B, respectively. In this manner, an optional number of the protrusions may be provided in the same sectional plane in this invention. However, the odd numbers as shown in FIGS. 2*b* and 2*d* are advantageous for the balance in stresses.

As can be seen from the above explanation, according to the invention, even if the male contact is very thin, the pressing force P more than a required value can be obtained owing to the negative value of the clearance G. According to the invention, moreover, the contacts are not subjected to any torsional force and other undesirable stresses. Therefore, the invention can provide a contact for a connector capable of realizing reliable and stable contact between contacts.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A contact for a connector, said contact including two opposed contact elements for receiving a male contact of a mating connector inserted therebetween in a direction of insertion;

each said contact element having a width and being provided with at least one protrusions for embracing said male contact, said protrusion of each of said two opposed contact elements extending to portions of said respective opposing contact elements devoid of said protrusions to overlap each other before said male contact is inserted therebetween, the sum of the total number of said protrusions on both said elements combined being at least three; and each of said protrusions being symmetrically arranged across said widths of said opposed elements on a perpendicular axis to said direction of insertion.

2. A contact for a connector as set forth in claim 1, wherein each said protrusion has a U-shaped cross-section in a plane substantially perpendicular to an inserting direction of said male contact.

3. A contact for a connector as set forth in claim 1, wherein each said protrusion is formed by bending the contact element along lines substantially perpendicular to an inserting direction of said male contact.

4. A contact for a connector as set forth in claim 1, wherein said protrusions are substantially aligned with each other in a direction substantially perpendicular to an inserting direction of said male contact on the opposed surface of each said contact element.

5. A contact for a connector as set forth in claim 1, wherein sum of numbers of said protrusions of said two opposed contact elements is an odd number more than three.

6. The connector defined in claim 1 wherein each of said protrusions is symmetrical about an axis.

7. The connector defined in claim 6 wherein said axes are perpendicular to said width of said connector elements.

* * * * *